United States Patent [19]

Hallmark et al.

[11] Patent Number: 4,950,844

[45] Date of Patent: Aug. 21, 1990

[54] METHOD AND APPARATUS FOR OBTAINING A CORE SAMPLE AT AMBIENT PRESSURE

[75] Inventors: Bobby J. Hallmark, Fort Worth; Milton B. Enderlin, Arlington, both of Tex.

[73] Assignee: Halliburton Logging Services Inc., Houston, Tex.

[21] Appl. No.: 333,676

[22] Filed: Apr. 6, 1989

[51] Int. Cl.[5] ..... E21B 49/06

[52] U.S. Cl. ..... 175/59; 175/233; 175/244; 73/863.11; 73/864.45

[58] Field of Search ..... 175/40, 44, 50, 58, 175/59, 77, 244, 46, 20, 226, 233, 236, 78, 246; 166/264; 73/864.44, 864.45, 38, 863.11

[56] References Cited

U.S. PATENT DOCUMENTS

| | | | |
|---|---|---|---|
| 2,238,609 | 4/1941 | Sewell | 175/233 |
| 2,445,494 | 7/1948 | Redmond | 175/59 |
| 2,456,331 | 12/1948 | Sewell | 175/233 |
| 2,734,719 | 2/1956 | Otway | 175/233 |
| 3,146,837 | 9/1964 | Bridwell | 175/244 |
| 3,148,740 | 9/1964 | Cauchois | 175/44 |
| 4,304,122 | 12/1981 | Tentor | 73/38 |
| 4,317,490 | 3/1982 | Milberger et al. | 175/59 |
| 4,425,810 | 1/1984 | Simon et al. | 73/863.11 |
| 4,714,119 | 12/1987 | Hebert et al. | 175/58 |

*Primary Examiner*—Bruce M. Kisliuk

*Attorney, Agent, or Firm*—William J. Beard

[57] ABSTRACT

For use with a core sample tool removing a sample from a formation of interest, a sonde supported sample receiving chamber is disclosed. It includes a main valve for sample insertion into a cavity in a resilient sleeve. The sleeve is in a chamber connected by suitable valved passages to enable ambient pressure at the cavity to equal downhole pressure; by valve operation this pressure can be maintained after chamber removal and transfer.

23 Claims, 3 Drawing Sheets

METHOD AND APPARATUS FOR OBTAINING A CORE SAMPLE AT AMBIENT PRESSURE

BACKGROUND OF THE DISCLOSURE

This disclosure is directed to a remote control core sample cutting apparatus which particularly includes a closed and sealed cylinder having an internal chamber for receiving a core sample after cutting which is maintained at prevailing downhole pressures receive and store the sample at that pressure. It particularly enables the sample to be retrieved with connate fluids in the core sample.

This feature finds its use especially with a core testing apparatus which forms a core, the improvement relating to the core storage cylinder. In a typical situation, a well has been partially, perhaps even completely drilled and is in the open hole condition. Formations of interest have been identified based on other testing procedures, but the well completion process is materially aided and assisted by furnishing a core sample which is soon analyzed at the surface. A testing tool which cuts a core sample is thus lowered into the open borehole and a core sample is taken. After the core sample has been retrieved to the surface, it is then tested to obtain additional information regarding the nature of the formation and whether or not selected completion procedures need to be implemented for that formation. At least two changes occur on removal of the core sample from the well borehole. These changes degrade the core sample, and may well mislead the analyst who reviews the data obtained from the core sample during surface testing. Among other changes, the core sample is removed from the ambient temperature and pressure which prevailed at the formation of interest. The temperature and pressure change occurs during removal of the testing tool from the borehole, potentially enabling oil, gas, water or other fluids captured in the pores of the sample to escape. This leads to an unwanted detrimental result, namely that connate fluids from the formation potentially escape from the core sample and are lost. For instance, if the formation of interest is sufficiently pressured certain light hydrocarbons may exist as light liquids and may boil off in the gaseous state and evaporate when exposed to a reduced temperature and pressure. At least, certain light molecules will escape. Any analytical data thereafter obtained from the core sample will be in error, at least to the extent of loss of connate fluids as gas.

This apparatus incorporates a closed and sealed cylinder which has an internal chamber. After the core sample has been cut, the cylinder is opened while the tool is at the requisite depth, the sample is thereafter retrieved from the formation and inserted into the cylinder. The cylinder is selectively opened and closed to capture the core sample. Moreover, fluids in the core sample are maintained at the prevailing pressures and temperatures until they are enclosed in the cylinder. After sealing, the connate fluids along with the core sample are not permitted to escape and the retrieved sample more nearly represents prevailing conditions at the formation of interest.

The present apparatus thus discloses a sample cutting tool in a sonde adapted for lowering in a borehole on a logging cable. The sonde supports a mechanism operating the core holder to extend into the formation, cut a core, capture the core within the holder and retrieve the core sample from the formation back into the sonde. A removable cylinder is loaded into the sonde at the surface. The cylinder is aligned so that it has an opening through which the core holder can be inserted. A core punch is extended to drive the core sample from the core holder and it is forced into the cylinder. The cylinder has appropriate valves and seals to limit entry so that it can be opened and closed to timely receive the core sample. The removable cylinder is preferably operated with a pressure balance system so that cylinder internal pressure equals the pressure at the formation of interest. The cylinder has other fittings and valves enabling connections to be made to the cylinder after retrieval from the surface The fittings and valves enable controlled pressurization of the interior of the cylinder which thereby regulates the pressure on the sample. Appropriate tests can be run on the sample at the surface while maintaining the sealed system around the core sample. Such tests include measuring saturation of the core sample with connate fluids including gases, oil, and water. Electrical induction tests can also be run in the cylinder. The disclosure sets forth the cooperative surface equipment which is releasably connected to the cylinder to accomplish these tasks.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
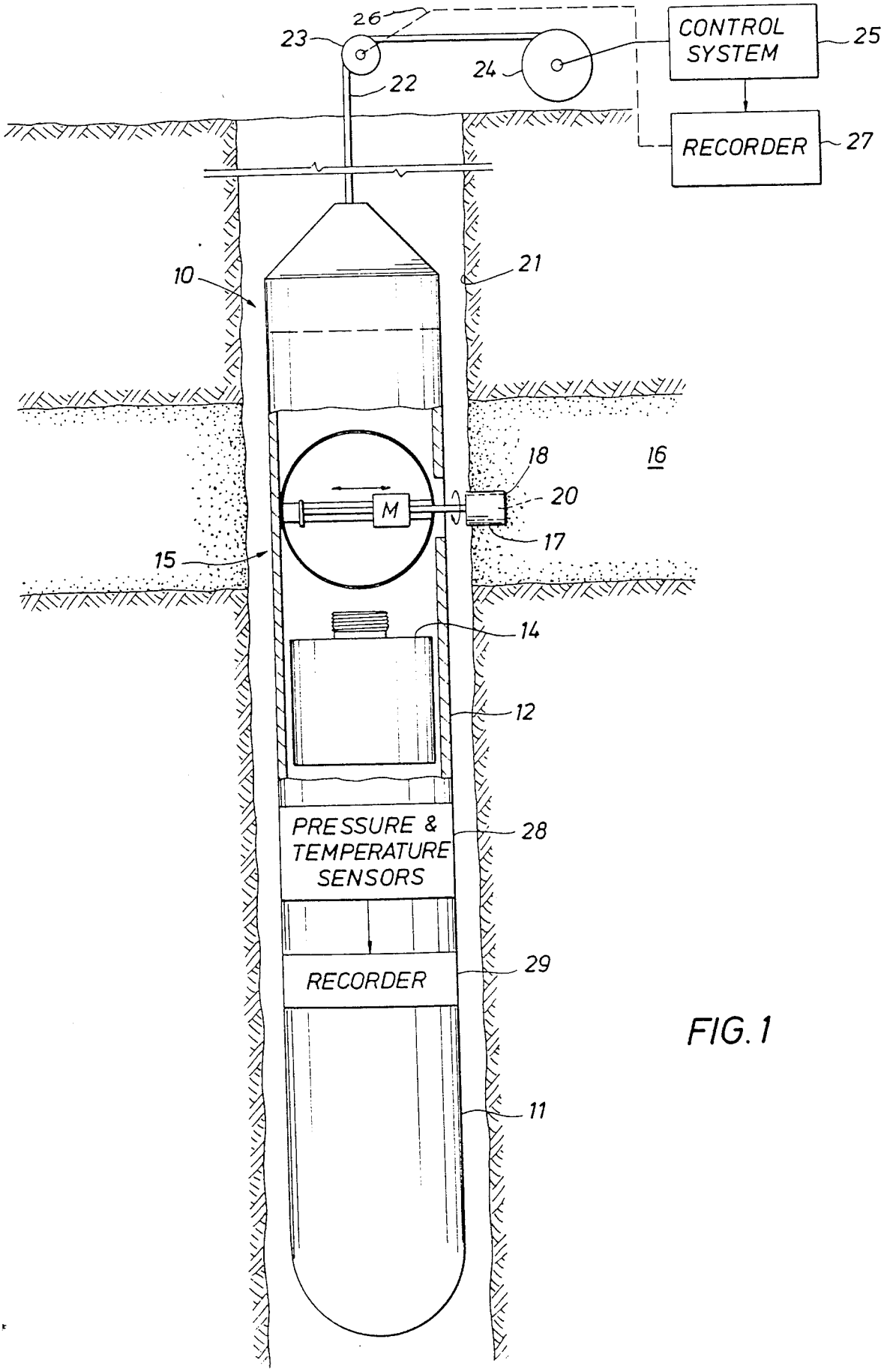
FIG. 1 shows a core sample cutting tool in a sonde lowered in an open borehole for cutting and removing a core sample from a formation of interest.

Attention is now directed to FIG. 1 of the drawings There, a sonde 10 including a core sample cutting and retrieval system is illustrated. It will be described generally as a core sample testing tool, or CST hereafter. The CST 10 includes a sealed housing 11 which encloses the operative equipment. In addition, the sonde is open at 12 to prevailing pressure, and moreover defines an internal chamber for receiving a removable cylinder 14. The numeral 15 identifies apparatus for extending outwardly into a formation 16 to cut and remove a cylindrical core sample from that formation. The cutting apparatus which forms the core sample is believed to be well known and requires no further disclosure; it operates primarily with a motor driven cylindrical core holder 17 which is constructed with a set of cutting teeth at the outer end 18. The teeth 18 cut a cylindrical divot from the formation which is telescoped into the core holder. In that sense, the core holder serves a dual purpose, the first being to cut the divot, and the second purpose being to capture the divot internally so that it can be retrieved into the CST 10. A suitable motor and transport mechanism is included. The core sample 20 captured in the core holder 17 is a cylindrical plug removed from the side wall of the borehole 21. The foregoing sample step is carried out at a particular depth, often quite deep, where the CST is suspended on a logging cable 22. It is retrieved from the borehole 21 on the logging cable extending to the surface and passing over a sheave 23. The logging cable is spooled on a drum 24. The surface equipment additionally includes a control system 25 which is connected to the conductors in the logging cable to provide timing and sequencing control signals. The depth of the formation 16 is determined by depth measuring equipment 26 which records travel of the logging cable 22, and the depth is input to a recorder 27 so that the formation depth is captured. Appropriate operating signals can also be recorded so that there is assurance that the sequence of operation has been properly recorded at a selected depth.

The sonde 10 incorporates appropriate pressure and transducer sensors 28. These form output signals delivered to the surface through the logging cable 22 by an appropriate telemetry system and are recorded at the recorder 27. Alternately, they can be recorded in a recorder 29 in the sonde. The sonde includes other measuring and testing equipment which operates independently of the equipment described to this juncture.

Figure 2:
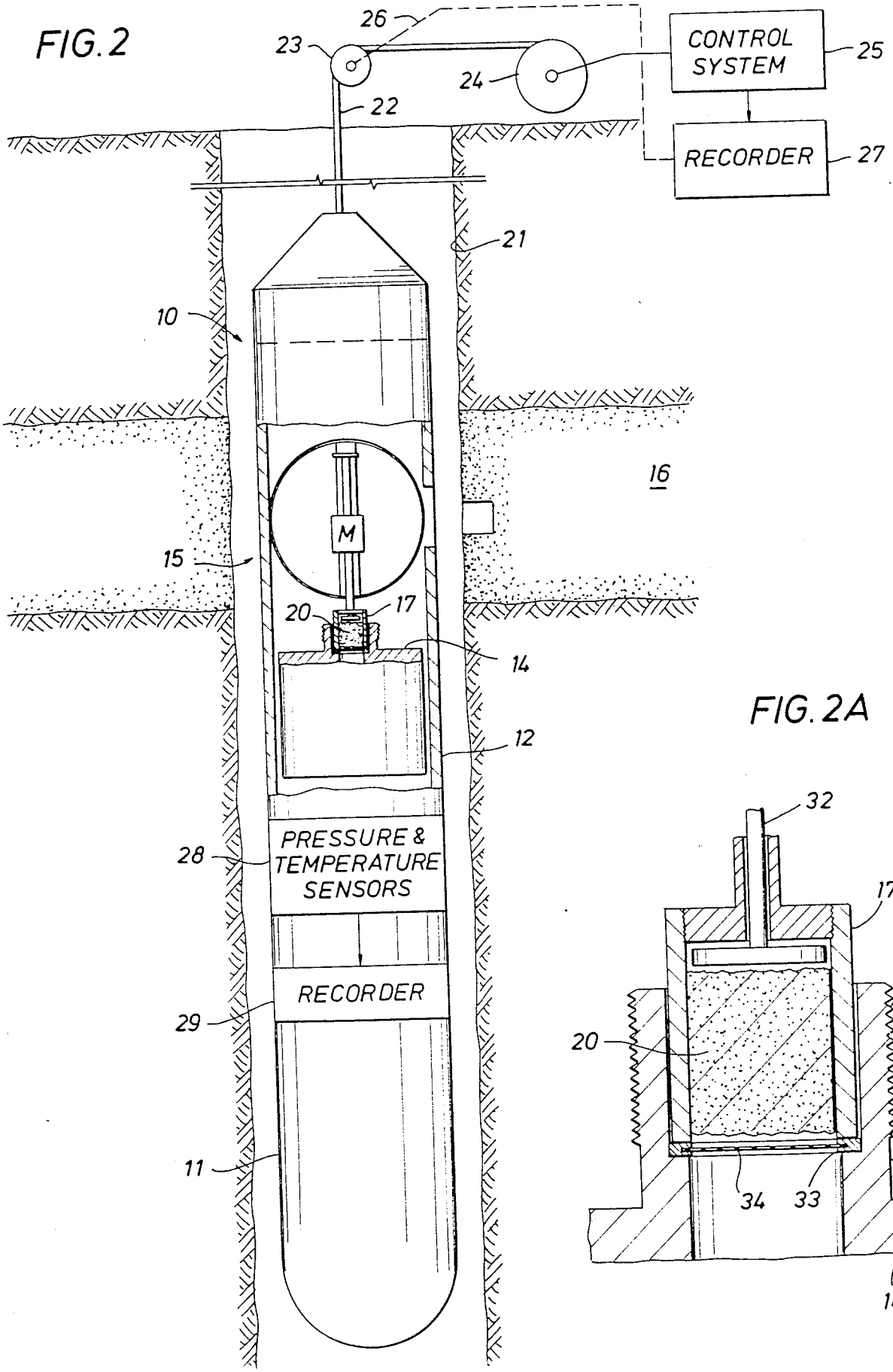
FIG. 2 is a view similar to FIG. 1 showing transfer of the core sample removed from the formation and inserted into a cylinder within the sonde.

The cylinder 14 is received in a portion 12 of the sonde housing which is open to ambient pressure. The sonde has pressure isolated portions elsewhere; the central portions of the sonde are illustrated showing an opening in the sonde to permit the core holder 17 to extend outwardly. FIG. 1 further shows that the cylinder 14 is mounted at a specific location relative to the core holder 17, thereby enabling operation of the equipment to form the plug 20 which is thereafter removed from the formation, and which is inserted into the cylinder 14. This sequence of operation is better understood on reference to FIG. 2 of the drawings. There, the core holder 17 is shown in alignment with the cylinder 14. The cylinder 14 includes an upstanding threaded collar 30 which is threaded at 31, and it is sized so that the core holder 17 fits therein. A core punch 32 is lowered to drive the plug 20 out of the holder 17 into the cylinder 14. The cylinder is constructed with an internal seal ring 33 which supports a sacrificial seal diaphragm 34. This covers over the interior of the equipment, and is held intact until the plug 20 is forced through it. The CST thus first cuts and forms the plug 20, retrieves the plug from the formation 16, and thereafter aligns the plug with the cylinder 14. The core punch 32 is extended to drive the plug out of the core holder 17. When that occurs, the plug 20 is forced through the diaphragm 34. It is relatively thin and is provided to assure fluid separation so that drilling fluids do not enter the cylinder 14. The cylinder is stored in the CST 10 in an open position; fluid entry, however, is prevented by the thin diaphragm 34. As the cylinder is lowered into the well, internal pressure within the cylinder is equalized with the external pressure so that the differential across the diaphragm is maintained at the minimum. More will be noted concerning this hereinafter.

CYLINDER CONSTRUCTION

Figure 3:
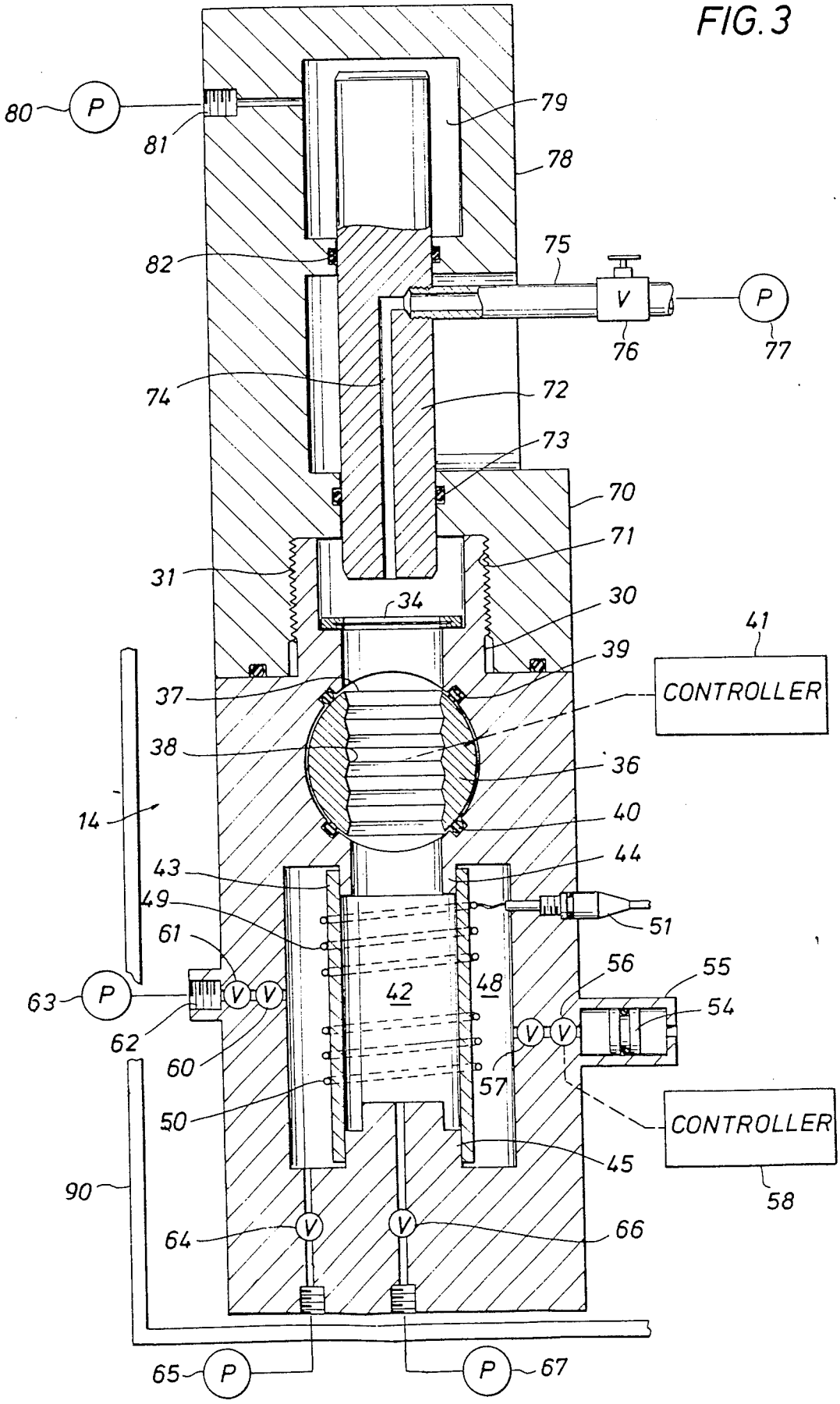
FIG. 3 cylinder supported in the sonde in FIGS. 1 and 2 after removal and connected with surface located equipment for providing controllable loading on the core sample and otherwise to vary conditions within the cylinder for sample testing.

Going now to FIG. 3 of the drawings, the cylinder 14 has been removed from the CST 10 and is shown with the various connections made to it which enable operation. That is, FIG. 3 shows the cooperative equipment which connects with the cylinder The description below will begin with the cylinder, describing the cylinder in the condition prevailing when first installed at the surface in the CST 10. The test equipment used in the lab after retrieval of the CST 10 will be described thereafter.

The cylinder 14 includes a master valve 36 which is rotatable about an axis perpendicular to the plane of FIG. 3. It includes a central passage 37 which is sufficiently large to receive the plug 20 therethrough. A resilient sleeve is placed in the passage 37 and incorporates protruding ribs 38 which wipe the plug when it is inserted through the master valve. The valve element 36 is protected by ring seals at 39 and 40. There is a valve controller 41 which is connected for operation of the valve element 36. The element 36 is shown in the open position in FIG. 3 but it is rotated 90° to a closed position. The controller 41 provides this rotation. The controller 41 is duplicated, therebeing a controller in the CST 10 which connects with the valve 36, and a duplicate is also included in the test lab for connection with the valve 36 to rotate that valve in the laboratory. A central chamber 42 is located internally of a resilient sleeve 43. The sleeve is sealed on an upstanding nipple 44 and seals to isolate the interior of the sleeve 43. In like fashion, a similar connection is made on the nipple 45 so that the sleeve is axially aligned, supported at both ends, and defines a pressure isolated chamber 42. This is the chamber for receiving the plug 20. The chamber is adjustable in diameter as the sleeve is either expanded or contracted in response to pressure loading. A larger chamber 48 surrounds the sleeve and is confined within the body of the cylinder 14. The chamber 48 receives hydraulic oil to apply squeezing pressure to the sleeve 43. The sleeve also supports a first surrounding coil 49 and a similar spaced coil 50. The two coils are identical in operation and are spaced along the sleeve for purposes to be described. The coils connect with appropriate pressure resistant electrical feedthroughs exemplified at 51. This enables external connection with suitable AC voltage sources which provide the appropriate driving signals for the coils 49 and 50.

There are several valves incorporated in the present system. These valves are included to control pressure either within the chamber 42 or the chamber 48. The sequence of operating these valves will be more readily apparent hereinafter. To this end, the valves connect with the appropriate pressure fluid sources as will be described and include controllers for opening and closing the valves. Dynamic pressure equalization between the interior of the cylinder 14 and the ambient pressure downhole is accomplished through a pressure balance piston 54 received in a cylinder 55 and communicated by means of serial valves 56 and 57 with the chamber 48. The chamber 48 is preferably filled with hydraulic oil. Hydraulic oil is also placed in the cylinder 55. One end of the cylinder is exposed to the chamber 48 through the two valves 56 and 57. The other end is exposed to ambient or prevailing pressure in the borehole at the depth at which the sample is cut. The valve 56 is provided with a controller 58. Before the CST 10 is lowered into the well, both the valves 56 and 57 are opened. This transmits prevailing pressure to the interior of the cylinder 14. This pressure is noted at the membrane 34 which is exposed to a pressure balance. This avoids premature rupture of the membrane. Thus, prevailing or ambient pressure in the well is transferred through the cylinder 54 into the chamber 42. Before the CST 10 is lowered into the well, the chamber 42 is preferably filled with a non-compressible fluid to the membrane 34. This fluid preferably has minimal impact on the plug. As an example, a mild salt solution will suffice. In some instances, it may be desirable to use other liquids as might be required. In any case, the chamber 42 is filled to the membrane 34 so that an non-compressible, fully filled system is provided and it is sustained at the dynamic pressure prevailing at the depths accomplished by the CST 10.

There is an additional fluid route into the chamber 48. This route utilizes connections made at the test lab after retrieval of the cylinder 14. This incorporates serial valves 60 and 61 and opens at the port 62 for connection with the pump 63 at the test lab. Again, the valves 60 and 61 are provided with controllers for opening and closing, thereby regulating the delivery of hydraulic oil through the port 62 from the pump 63.

Another opening into the chamber 48 is through the valve 64 which is operated by an appropriate controller (not shown) and which connects with the external pump 65. In like fashion, there is another valve 66 which responds to pressure from the pump 67 to deliver pressurized fluid into the chamber 42. As will be observed, there are three passages into the chamber 48. One of the passages is preferably dedicated to use with the pressure balance piston 54 and cylinder 55 previously discussed. The other two can be combined, but it is generally more convenient to operate with separate passages for reasons to be set forth. Where there are two valves serially connected in the passage, one is typically included as a safety seal valve. To this end, the valves 57 and 60 provide such safety or double locking. The valve 61 is preferably a one way pressure opened valve. In other words, it provides a check valve function FIG. 3 shows additional equipment which is used with the pressure test procedure. This is equipment installed at the laboratory and connected with the cylinder 14. This equipment thus includes a lower threaded fitting 70 which threads over and engages the threads 31 with the threads 71. This makes a leak proof connection. This supports a plunger 72. The plunger passes through a fluid seal 73 which prevents leakage along the plunger. The plunger is axially hollow with a passage 74. The passage 74 extends upwardly and connects out of the plunger by means of a connective tubing 75 and passes through a hand valve 76. In turn that permits connection with a fluid pump 77.

The plunger includes an upper end enclosed by a closed cylinder 78. There is a plunger chamber 79 at the upper end of the plunger. A port is included to enable a pump 80 to connect by a suitable fluid flow line through the port 81 to deliver hydraulic oil under pressure for extending the plunger. The plunger chamber 79 is pressure isolated by a surrounding seal 82. In use the plunger is driven downwardly to force the plug 20 into the chamber 42 defined by the resilient sleeve. In fact, the plunger is preferably sized so that it can center on and rest on the plug 20. The plunger is sufficiently small in diameter that it can pass through the master valve 36 without jamming. It is aligned for this purpose when the threads 71 are threaded to the cylinder 14.

DETAILED DESCRIPTION OF OPERATION

The first step in describing operation of the present apparatus is to specify the conditions of the equipment prior to putting the CST 10 in the well. The cylinder 14 is installed in the sonde. The cylinder a noted before has several valves which are placed in initial conditions. The initial conditions include the following for the cylinder 14 and its equipment. The master valve 36 is in the open position so that it is aligned with the chamber 42. The chamber 42 is filled with an incompressible fluid, and the sacrificial diaphragm or membrane 34 is replaced. When installed in the sonde, the valves 56 and 57 are placed in the open condition so that pressure equalization between the ambient external pressure around the sonde and the pressure on the interior is equalized. The valves 60, 61, 64 and 66 are closed at this juncture. The piston 54 comprises a portion of equipment supported in the sonde, the piston being located to communicate hydraulic fluid into the chamber 48 to continue the pressure balance discussed above.

Figure 2A:
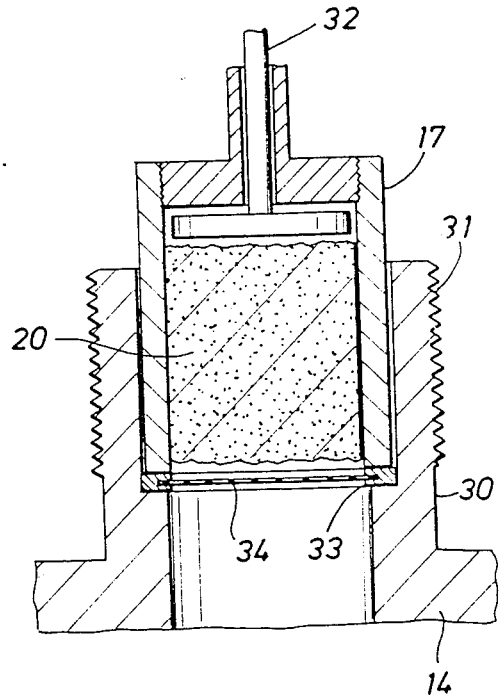
FIG. 2A is an enlarged sectional view of the core sample prior to storage.

While the apparatus is lowered into the well, pressure within the chamber 48 is raised as it merely follows ambient pressure. Ultimately, a core is cut by the core cutter, and it is thereafter prepared for insertion into the cylinder 14. By aligning the core 20 held in the surrounding cylindrical holder, the next step is insertion of the core into the cylinder 14. Insertion is accomplished by forcing the core through the sacrificial membrane 34 which is ruptured. The core is pushed through the valve element 36. The core external surface is wiped by the protruding circular ribs, and the core is forced into the storage chamber 42 by the apparatus shown in FIG. 2A. Fluid is displaced from the chamber 42 during core insertion and excess fluid flows out of the way through the valve 36 and also by expansion of the chamber 42 which relieves the pressure build up ahead of the inserted core. This chamber 42 swells the resilient sleeve 43. Once the core sample is inserted and all equipment has cleared the valve element 36, the controller 41 is operated to rotate the valve and thereby close off access to the cylinder 14. After this occurs, subsequent fluid entry is prevented. At this juncture, a certain absolute pressure is maintained in the chamber 48. Recall that this reflects correctly the ambient pressure. The controller 58 is operated and the valve 56 is closed. All of this occurs while the CST 10 is at the depth of the formation of interest. Accordingly, the pressure trapped in the chamber 48 corresponds to ambient pressure at that depth. Obviously, the resilient sleeve 43 transmits this pressure level to the chamber 42. Accordingly, this captures the core sample with connate fluids, all maintained at ambient pressure.

The CST 10 is thereafter retrieved from the well. On retrieval, it is delivered to the surface and the cylinder 14 is detached from the CST. It is then transported to a laboratory. Detachment from the CST involves the mechanical expedient of detachment from the pressure balance piston 54. In the lab, device is then prepared for testing of the core sample and other experiments as appropriate. To this end, the threads 31 are threaded to the threads 71 of the laboratory test fixture. The pumps 63, 65 and 67 are connected to the indicated fittings. In addition, the pump 80 is connected to the port 81 to supply pressure fluid for insertion of the piston 72. Likewise, the pump is connected to the flow line 74 through the piston.

An initial step is to determine the pressure within the chambers 42 and 48. By means of a suitable controller, a valve is opened to obtain access to the two chambers. Fluid access is controllably determined through the valves 60, 61, 64 and 66. The pump 77 is operated in conjunction with the valve 76 to deliver pressure fluid above the master valve 36. The piston 72 is extended partially downwardly under control of the pump 80. This is done before the valve 36 is opened. This enables bringing pressure up to approximately the pressure in the chamber 42. When the master valve 36 is operated, it is rotated to the open position and the piston 72 can then extend into the chamber 42. Typical testing procedures involve extending the piston 72 until the core is contacted thereby which captures the core at its cylindrical ends above the nipple 45. Again, a pressure is maintained in this region which is equal to the pressure of the formation at the time the core sample was taken. As desired, a furnace 90 surrounding the cylinder 14 in the laboratory can be used to heat the core sample to imitate downhole conditions.

Testing procedures utilizing well known laboratory equipment can then be carried out on the core sample. For instance, the valves 64 and 66 are furnished for this. One test to be run at this juncture is oil saturation, that is, measuring the oil making up the connate fluids of the sample. Another test is water saturation. The permeability of the core sample can also be measured. Induction electrical measurements of the core utilizing the electrical coils 49 and 50 can also be measured. Particle grain size can be measured. All these tests can be accomplished which the core remains in the cylinder 14. Moreover, they can be accomplished which the core is at elevated pressure If need be, these tests can be carried out in a surrounding oven to elevate the temperature of the core to that which prevailed at the formation o interest, previously measured during core sample removal. Ultimately, the core testing is concluded whereupon the cylinder 14 can be opened, the core removed and thereafter physical measurement such as weight can be taken using other laboratory equipment.

While the foregoing is directed to the preferred embodiment, the scope is determined by the claims which follow

What is claimed:

1. Apparatus for capturing a core sample cut from a formation of interest, comprising:

(a) demountable chamber means having:
  (1) a surrounding housing;
  (2) a central, top located, core receiving opening;
  (3) a valve element with a core sized passage therethrough for receiving a core into said housing;
  (4) means for operating said valve element to open and close; and
  (5) an internal core receiving cavity formed by a surrounding resilient sleeve;
(b) a fluid chamber surrounding said sleeve;
(c) fluid pressure transfer means extending from the exterior of said chamber means to said fluid chamber;
(d) first and second valve controlled fluid passage into said fluid chamber and internal cavity;
(e) means for mounting said chamber means on a laboratory test instrument; and
(f) means enabling a laboratory test instrument piston to extend into said chamber means to load the core in said cavity.

2. A method of obtaining a core sample from a well borehole and placing the core sample in a removable core sample chamber including an internal core sample cavity and a fluid isolating wall defining said cavity around the core sample and the method comprises the steps of:

(a) positioning the removable chamber in a sonde;
(b) lowering in the borehole the sonde supporting a core cutter to enable cutting a core sample from a formation of interest;
(c) controllably transferring the core sample by insertion of the core sample into the open removable chamber to receive the core sample and connate formation fluids;
(d) isolating fluid in the chamber to equal the ambient pressure at the formation of interest after insertion of the core sample into the removable chamber;
(e) sealing the cavity after core insertion;
(f) opening a valve means to regulate fluid pressure on the wall to ambient pressure;
(g) closing the core sample receiving removable chamber to capture the core sample;
(h) measuring ambient conditions at the formation of interest;
(i) retrieving the sonde from the well; and
(j) removing the chamber with the core sample therein at the isolated pressure.

3. The method of claim 2 including the step of initially isolating the chamber prior to core sample insertion, and thereafter inserting the core sample with connate formation fluids.

4. The method of claim 3 including the step of cutting the sample in situ with connate formation fluids.

5. The method of claim 2 including the steps of:

(a) operating a sample core cutter at the formation of interest to obtain a core sample in the core cutter;
(b) aligning the core cutter with the removable chamber;
(c) ejecting the core sample from the core cutter into the removable chamber; and
(d) removing the chamber from the sonde.

6. The method of claim 2 including the step of applying a fluid pressure source to the removable chamber to controllably change the pressure on the core sample therein.

7. The method of claim 2 including the step of testing the core sample in the removable chamber.

8. The method of claim 2 wherein the sample is tested for oil saturation.

9. The method of claim 2 wherein the sample is tested for water saturation.

10. The method of claim 2 wherein the sample is tested for electrical induction.

11. The method of claim 2 wherein the sample is tested for particle size.

12. The method of claim 2 wherein the sample is tested for permeability.

13. The method of claim 2 wherein the test is at ambient temperature of the formation of interest.

14. The method of claim 2 including the initial steps of:

(a) filling the core sample receiving chamber with an incompressible fluid;
(b) opening a valve element aligned with the chamber to enable core sample insertion therethrough;
(c) covering the chamber with sacrificial cover; and
(d) continually changing the pressure in the chamber as the sonde is lowered into a well borehole.

15. The method of claim 13 including the step of aligning the core sample with the chamber after removal from the formation; and inserting the core sample into the chamber through the cover and the valve element.

16. The method of claim 15 including the subsequent steps of closing the open valve element to capture the core sample therein; and controllably operating a valve means isolate pressure in the chamber.

17. The method of claim 16 including the step of pushing the core sample into the chamber by extension of an extendible means and further including the step of wiping the core sample during insertion in the chamber.

18. The method of claim 17 including the step of enclosing the core sample with a resilient sleeve, in the chamber, and holding the core therein.

19. A method of obtaining a core sample in a core sample receiving chamber from a well borehole comprising the steps of:

(a) initially filling the core sample receiving chamber with an incompressible fluid;

(b) initially opening a valve element aligned with the chamber to enable core sample insertion therethrough;

(c) covering the chamber with a sacrificial cover;

(d) continually changing the pressure in the chamber as the sonde is lowered into a well borehole.

(e) positioning a removable chamber in a sonde;

(f) lowering in the borehole the sonde supporting a core cutter to enable cutting a core sample from a formation of interest;

(g) controllably transferring the core sample by insertion of the core sample into said removable chamber;

(h) isolating pressure in the chamber equal to the ambient pressure at the formation of interest after insertion of the core sample into the removable chamber;

(i) retrieving the sonde from the well; and (j) removing the chamber with the core sample therein at the isolated pressure.

20. The method of claim 19 including the step aligning the core sample with the chamber after removal from the formation; and inserting the core sample into the chamber through the cover and the valve element.

21. The method of claim 20 including the subsequent steps of closing the open valve element to capture the core sample therein; and controllably operating a valve means isolate pressure in the chamber.

22. The method of claim 21 including the step of pushing the core sample into the chamber by extension of an extendible means and further including the step of wiping the core sample during insertion into the chamber.

23. The method of claim 22 including the step of enclosing the core sample with a resilient sleeve, in the chamber, and holding the core therein.

* * * * *